United States Patent [19]

Wu

[11] Patent Number: 4,603,559

[45] Date of Patent: Aug. 5, 1986

[54] WATER-COOLED AIR CONDITIONER

[76] Inventor: Ming W. Wu, No. 157, Sec. 1 Chung-Hwa Road, Tainan, Taiwan

[21] Appl. No.: 752,634

[22] Filed: Jul. 8, 1985

[51] Int. Cl.[4] ..... F25D 17/02

[52] U.S. Cl. ..... 62/434; 62/305; 62/506

[58] Field of Search ..... 62/434, 506, 305; 165/122

[56] References Cited

U.S. PATENT DOCUMENTS

| | | | |
|---|---|---|---|
| 3,118,290 | 1/1964 | Weller | 62/506 |
| 3,130,557 | 4/1964 | McFarlan | 62/305 X |
| 3,908,393 | 9/1975 | Eubank | 62/506 X |
| 4,302,944 | 12/1981 | Gainer | 62/434 |
| 4,480,445 | 11/1984 | Goldstein | 62/434 |

*Primary Examiner*—Lloyd L. King
*Attorney, Agent, or Firm*—Steinberg & Raskin

[57] ABSTRACT

This invention relates to an improved water-cooled air conditioner and in particular to one which comprises a main body. A condenser provided with a condensing coil is disposed in the middle portion of the main body. The interior of the condenser is filled with water, while the refrigerant is received in the condensing coil therein. An evaporator provided with a cooling coil is disposed in the lower portion of the main body. The cooling coil is connected to the condensing coil via an expansion valve. A cooling device serving as a cooling tower is disposed in the upper portion of the main body. A compressor is disposed on the outside of the main body to provide the heated refrigerant for the condenser and to receive the cooled refrigerant from the evaporator. A ventilating device is disposed around the condenser to provide a further cooling effect. A heating device is disposed in the lower portion of the main body below the evaporator to heat the water received in the evaporator.

6 Claims, 3 Drawing Figures

WATER-COOLED AIR CONDITIONER

BACKGROUND OF THE INVENTION

This invention relates to an improved water-cooled air conditioner.

The conventional air conditioners generally are categoried into two types; the water-cooled type and the air-cooled type. This invention is to provide an improved air conditioner for the water-cooled type only.

The main body of the conventional water-cooled air conditioner only comprises a condenser and an evaporator. A cooling tower is separated from the main body thereof and disposed on outside of the house, thereby increasing the installation cost and wasting the electric power. Referring to FIG. 3, the condenser (20) of the conventional air conditioner is filled with refrigerant, and the condensing coil (201) received in the condenser (20) is filled with cooled water which is supplied by the cooling tower (not shown). Since the size of the condenser (20) is somewhat limited, the heat dissipating surface of the condensing coil (201) thereof can hardly be significantly increased. Besides, in cleaning, the dust attached to the interior of the condensing coil (201) can not be effectively removed, thus the heat exchanging efficiency therein can not be increased.

SUMMARY OF THE INVENTION

It is, therefore, an object of the present invention to obviate and mitigate the above-noted drawbacks.

It is the primary object of the present invention to provide an improved water-cooled air conditioner wherein a cooling device to be served as the conventional cooling tower is combined with the condenser and the evaporator of the air conditioner to form a single unit.

It is another object of the present invention to provide an improved water-cooled air conditioner which can reduce the cost.

It is still another object of the present invention to provide an improved water-cooled air conditioner which is easy to install.

It is a further object of the present invention to provide an improved water-cooled air conditioner which is practical for use.

DETAILED DESCRIPTION OF THE PREFERRED EMBODIMENT

Figure 1:
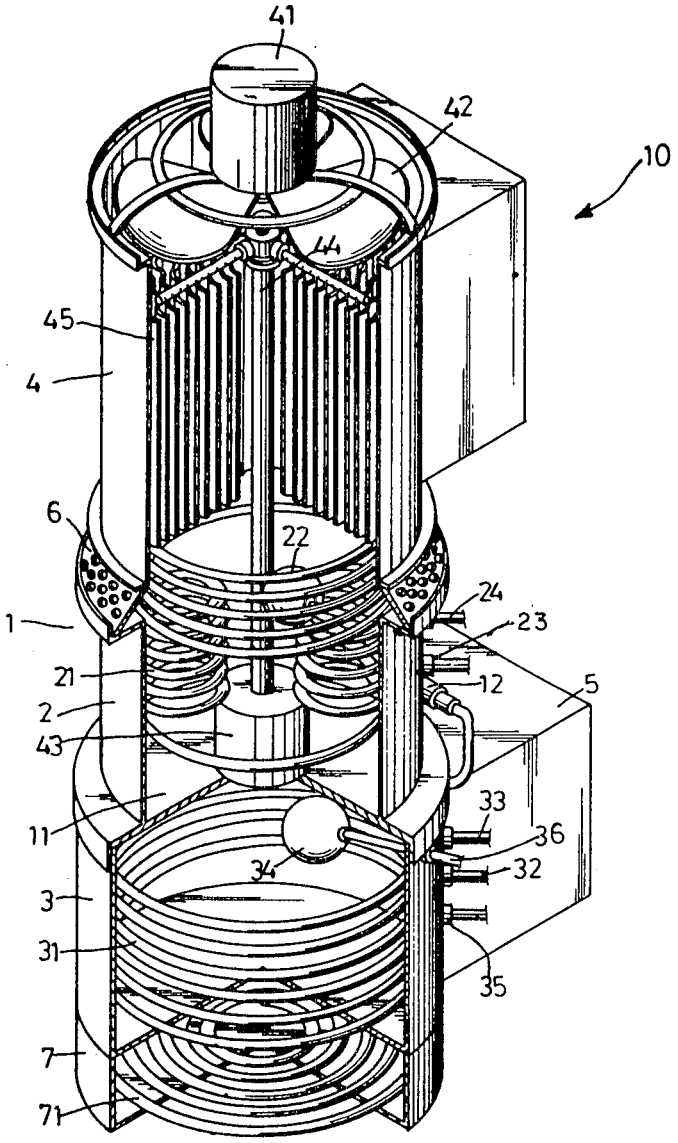
FIG. 1 is a perspective view, partially broken away, of a preferred embodiment of the present invention.

Referring to the drawings and in particular to FIG. 1 thereof, an improved water-cooled air conditioner (10) comprises a main body (1). A condenser (2) provided with condensing coil (21) is disposed in the middle portion of the main body (1). The condensing coil (21) is arranged to receive the high-pressure and high-temperature vaporized refrigerant which is compressed and supplied by a compressor (5) disposed adjacent to the condenser (2) thereof. The interior of the condenser (2) is filled with water which surrounds the condensing coil

(21) thereof in order to convert the high-pressure and high-temperature vaporized refrigerant into the high-pressure and low-temperature condensed refrigerant.

Figure 2:
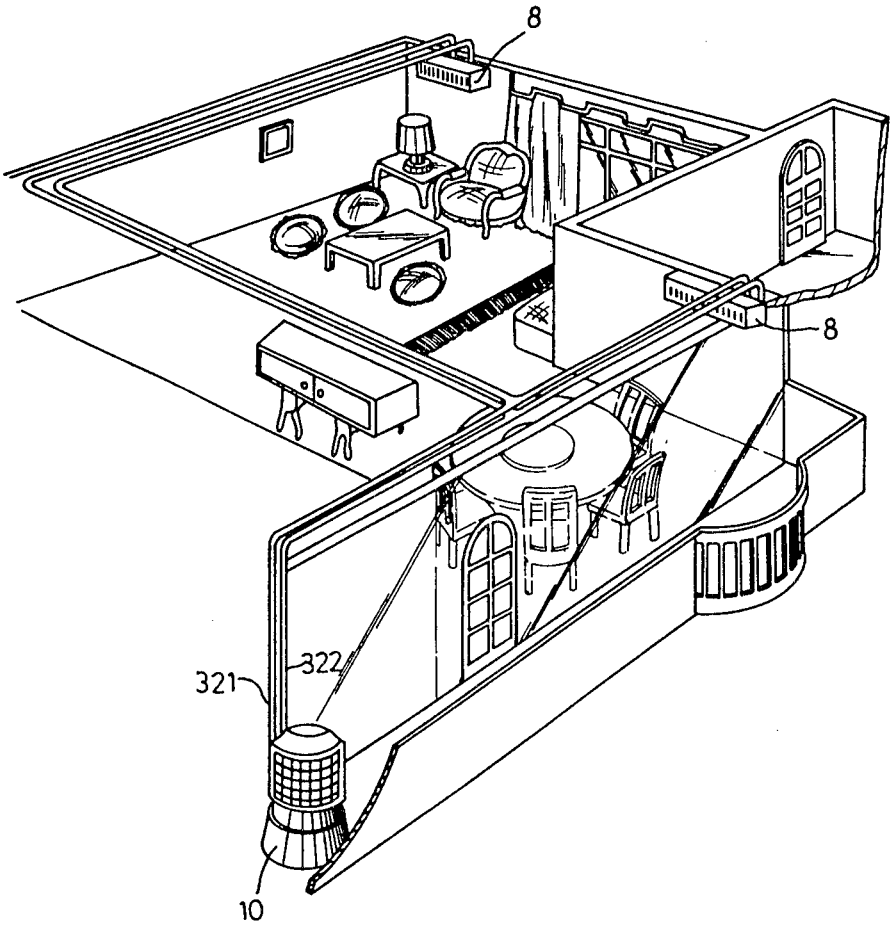
FIG. 2 is a perspective view thereof illustrating an improved water-cooled air conditioner as shown in FIG. 1, being disposed in a room.

An evaporator (3) is disposed in the lower portion of the main body (1) and separated from the condenser (2) by a plate member (11) preferably made of heat-insulated material. The evaporator (3) is provided with cooling coil (31) which is connected to the condensing coil (21) of the condenser (2) via an expansion valve (12) which can make the high-pressure and low-temperature condensed refrigerant expand and be converted into the low-pressure and low-temperature vaporized refrigerant thereby capable of absorbing the heat in the air. As the low-pressure and low-temperature vaporized refrigerant circulates in the cooling coil (31) of the evaporator (3), the temperature of the water surrounding the cooling coil (31) will be effectively reduced to become desired ice water, i.e., cooled water. Referring to FIGS. 1 and 2, the ice water is conveyed through the outlet (32) of the evaporator (3) and the first duct (321) connected to said outlet (32), to the diffuser (8) by means of a water pump (not shown), to provide a cooling effect therein, and then the ice water is sent back, through the second duct (322) and the inlet (33) of the evaporator (3), to the evaporator (3) in order to form a circulating path. Meanwhile, the low-pressure and low-temperature vaporized refrigerant circulating in the cooling coil (31) of the evaporator (3) will be sent back to the compressor (5) to be compressed into high-pressure and high-temperature vaporized refrigerant again.

A cooling device (4) is disposed in the upper portion of the main body (1) beyond the condenser (2). The cooling device (4) is furnished with a fan (42) driven by a motor (41) and a sprayer (44) connected to a water pump (43) disposed in the water (not shown) of the condenser (2). Under the sprayer (44) are disposed a plurality of heat dissipating plates (45) to provide a better dissipating effect. When the high-pressure and high-temperature vaporized refrigerant supplied by the compressor (5) is circulated in the condenser (2), the cooling device (4) is used to reduce the temperature of said refrigerant in a way such that the water pump (43) will pump the water received in the condenser (2) to the upper portion of the sprayer (44) and then will reduce the temperature of the water sprayed out therefrom by means of said fan (42) and said dissipating plates (45). Finally, the cooled water will, in turn, cool the refrigerant received in the condensing coil (21) and the same procedure will be repeated over and over again. Furthermore, ventilating means (6) is detachably disposed on the main body (1) and surrounds the condensing coil (21) thereof, thereby providing a further cooling effect for the refrigerant received in the condensing coil (21). A pair of first and second floating valves (22) (34) are respectively disposed in the condenser (2) and the evaporator (3) to control the water level therein. If necessary, fresh water can be added to the condenser (2) and the evaporator (3) respectively through the inlet (24) and the control valve (35) thereof.

Figure 3:
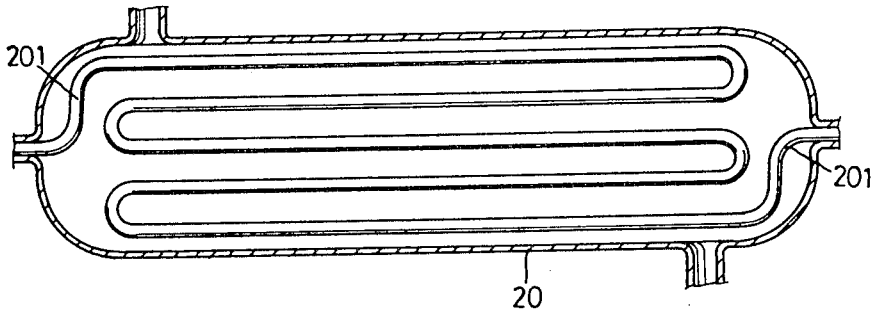
PRIOR ART FIG.3
FIG. 3 is a cross-sectional view of a conventional condenser with condensing coil received therein.

It is noteworthy that the refrigerant of this invention is received in the condensing coil (21) of the condenser (2) while the condensing coil (21) thereof is surrounded by the cooled water in the condenser (2). When intending to clean the condenser (2) of the present invention, the water received in the condenser (2) is first discharged through the control valve (23) which is properly formed in the periphery of the condenser (2). Secondly, the ventilating means (6) are removed. Thus the condenser (2) can be easily cleaned up without any obstacle. However, referring to FIG. 3, the cooling coil (201) of the conventional condenser (20) is filled with water instead of refrigerant whereby the dirt contained in the water is prone to be attached to the inner wall of the condensing coil (201). This makes the cleaning procedures for the conventional condenser more complicated than that for the present invention. Besides, the water received in the evaporator (3) can be discharged via the control valve (35) thereof.

Referring to FIG. 2, this invention can be disposed in the room without the existence of the conventional cooling tower which usually is located on the roof. Therefore, the size of the present invention can be significantly reduced thereby, being capable of facilitating the installing procedures. Furthermore the installation cost of the cooling tower and the ducts connected between the cooling tower and the air conditioner can be saved, thereby reducing the cost of the present invention.

Heating means (7) provided with heating coil (71) is disposed in the lower portion of the main body (1) below the evaporator (3). The heating coil (71) can heat the water received in the evaporator (3) to increase the temperature thereof such that the heated water can be sent, through the first duct (321) as shown in FIG. 2, to the diffuser (8) and then can be sent back, through the second duct (322) as shown in FIG. 2, to the evaporator (3) to form a complete circulating path. This arrangement can make the air conditioner (10) serve as a device capable of providing heated air for the room during the cold season. Besides, the air conditioner (10) can serve as heating means to supply the heated water for a family via an outlet (36) formed in the periphery of the evaporator (3).

Accordingly, this invention is directed to providing an improved water-cooled air conditioner (10) which can act as a multi-purpose device.

I claim:

1. An improved water-cooled air conditioner comprising a main body;

a condenser with a condensing coil formed therein being disposed in the middle portion of the main body, said condenser furnished with a floating valve, said condenser further provided in the periphery thereof with an inlet and a control valve such that the inlet and the control valve cooperate with the floating valve to regulate the level of water contained in the condenser or to clean the condenser;

an evaporator with a cooling coil received therein being disposed in the lower portion of the main body and separated from said condenser, an expansion valve connecting the cooling coil of the evaporator and the condensing coil of the condenser, said evaporator provided in the interior thereof with a floating valve and at the periphery thereof with an inlet and a control valve such that the floating valve is associated with the inlet and the control valve to regulate the level of water contained in the evaporator;

cooling means being disposed in the upper portion of the main body and communicating with said condenser, said cooling means provided at its center with a sprayer, a water pump disposed to be situated within the water contained in the condenser and being connected to the lower end of the sprayer, a plurality of dissipating plates disposed in the cooling means and located between the upper end of the sprayer and the condensing coil of the condenser, and an electric fan capable of being driven by a motor being disposed on the top of the cooling means and beyond said sprayer.

2. The air conditioner of claim 1, additionally comprising heating means comprising a heating coil disposed in the lower portion of the main body below the evaporator, such that the water contained within the evaporator may be heated by said heating means.

3. The air conditioner of claim 1, additionally comprising ventilating means detachably disposed on the main body and surrounding the condensing coil of the condenser, for providing additional cooling.

4. The air conditioner of claim 2, additionally comprising an outlet from said evaporator, whereby the water heated by said heating means can be removed from said evaporator.

5. The air conditioner of claim 1, additionally comprising an outlet conduit extending from said evaporator, an inlet conduit communicating with said evaporator, and at least one diffuser communicating with said outlet and inlet conduits, forming a circulating path for water to and from said evaporator.

6. The air conditioner of claim 1, additionally comprising a heat-insulated plate separating said condenser and said evaporator.

* * * * *